US005478035A

United States Patent [19]

Kneile

[11] Patent Number: 5,478,035

[45] Date of Patent: Dec. 26, 1995

[54] HEIGHT ADJUSTABLE SUPPORT LEG FOR FURNITURE, ESPECIALLY FOR FOLDING TABLES IN MOTOR HOMES AND TRAILERS

[75] Inventor: Karl Kneile, Holzmaden, Germany

[73] Assignee: Robert Krause GmbH & Co. KG, Weilheim, Germany

[21] Appl. No.: 169,491

[22] Filed: Dec. 17, 1993

[30] Foreign Application Priority Data

Dec. 17, 1992 [DE] Germany ..... 9217257 U

[51] Int. Cl.[6] ..... F16M 11/38

[52] U.S. Cl. ..... 248/188.6; 108/115; 248/351; 403/102

[58] Field of Search ..... 248/188.6, 188.8, 248/351, 188.1, 688; 403/84, 99, 102; 108/115, 160

[56] References Cited

U.S. PATENT DOCUMENTS

| | | | |
|---|---|---|---|
| 729,291 | 5/1903 | Dickerson | 248/188.6 X |
| 1,806,454 | 5/1931 | Goudeau | 248/188.6 X |
| 2,895,536 | 7/1959 | Davidson | 248/188.6 |
| 2,915,328 | 12/1959 | Walton | 403/102 |
| 3,153,525 | 10/1964 | Guth | 248/188.6 |
| 3,886,962 | 6/1975 | Diamontis | 403/102 X |
| 3,963,272 | 6/1976 | Jones | 248/188.8 X |
| 4,412,667 | 11/1983 | Doerner | 248/188.8 X |
| 5,364,201 | 11/1994 | LaBarre | 403/102 X |

FOREIGN PATENT DOCUMENTS 2614435 10/1977 Germany .

*Primary Examiner*—Ramon O. Ramirez
*Assistant Examiner*—Derek J. Berger
*Attorney, Agent, or Firm*—Robert W. Becker & Associates

[57] ABSTRACT

A height-adjustable support leg for furniture has an upper leg portion and a lower leg portion. A pivot is provided for pivotably connecting the upper and lower leg portions. The lower leg portion is pivotable from a horizontal position, in which the lower leg portion rests on the floor, into a stretched position of the support leg in which the lower leg portion is aligned with the upper leg portion. A latching mechanism for securing the lower leg portion in the stretched position against pivoting is provided. The latching mechanism has at least one latch-shaped release element that is automatically moved into a latching position upon pivoting the lower leg portion from the horizontal position into the stretched position. The lower leg portion is non-slidably connected to the pivot.

24 Claims, 4 Drawing Sheets

HEIGHT ADJUSTABLE SUPPORT LEG FOR FURNITURE, ESPECIALLY FOR FOLDING TABLES IN MOTOR HOMES AND TRAILERS

BACKGROUND OF THE INVENTION

The present invention relates to a height-adjustable support leg for furniture, especially for folding tables in motor homes and trailers, with an upper and a lower leg portion, wherein the lower leg portion can be pivoted about a pivot axis from a horizontal position in which it rests on the floor into a stretched position of the support leg in which it is aligned with the upper leg portion and in which position it can be secured against pivoting by a latching mechanism.

In a known support leg of this kind (German Patent 26 14 435) the upper leg portion is provided on its two lateral side portions with arresting bolts which in the latching position of the leg portions project into downwardly open recesses of the side portions of the upper leg portion. In order to prevent that the lower leg portion upon lifting of the table can pivot accidentally from the stretched position into the horizontal position, additional securing means, such as spring washers or spring rings, are provided which force the side portions, respectively, pivoting arms that are formed as an extension of the side portions of the lower leg portion under prestress against the upper leg portion and thereby achieve a frictional connection. Due to this frictional connection the lower leg portion is connected to the upper leg portion. In order to pivot the lower leg portion into the lowered position of the support leg, the lower leg portion must first be downwardly removed from the upper leg portion until the arresting bolts are freed from the corresponding recesses. In a similar fashion the lower leg portion must be displaced relative to the upper leg portion after pivoting so that the arresting bolts can engage the recesses. With this design it is possible that upon lifting of the table the lower leg portion can be displaced accidentally relative to the upper leg portion to such an extent that it comes free. This may result in the table tilting upon lowering.

It is therefore an object of the present invention to improve a support leg of the aforementioned kind such that in a simple manner a secure latching of the two leg portions in the stretched position of the support leg is ensured.

BRIEF DESCRIPTION OF THE DRAWINGS

This object, and other objects and advantages of the present invention, will appear more clearly from the following specification in conjunction

SUMMARY OF THE INVENTION

Figure 1:
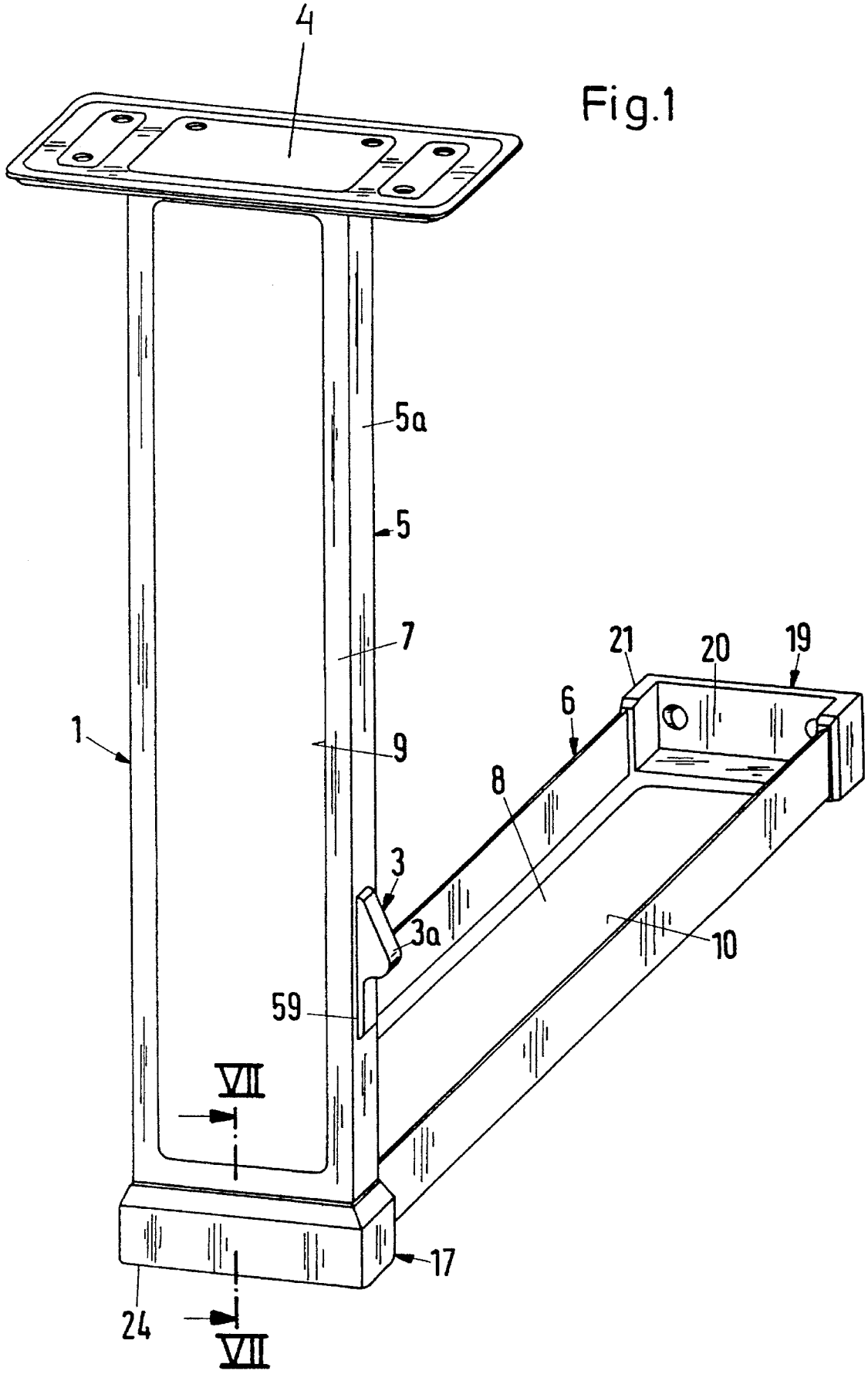
FIG. 1 shows a perspective representation of the inventive support leg in its angled (pivoted) position.
Figure 2:
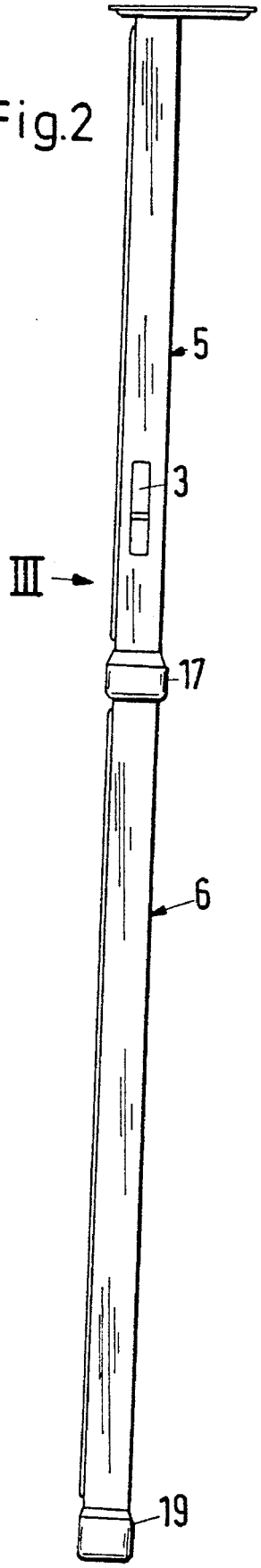
FIG. 2 shows a side view of the support leg of FIG. 1 in its stretched position.
Figure 3:
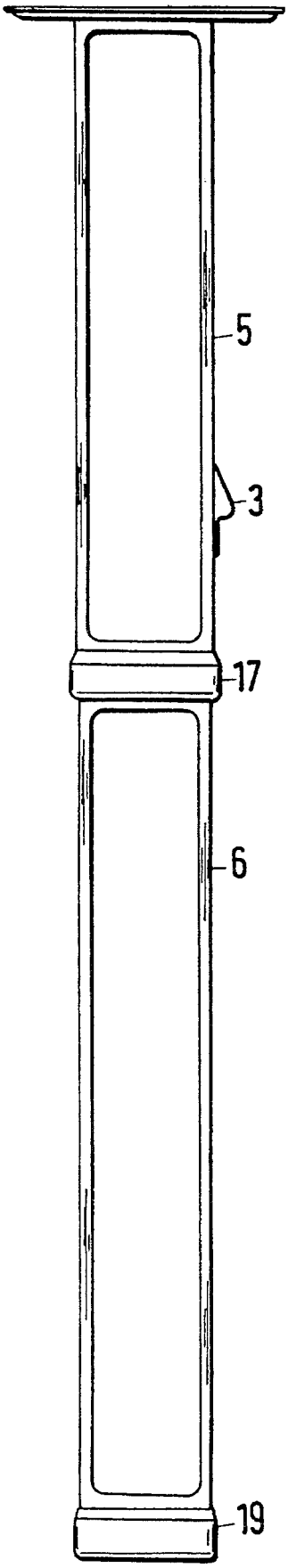
FIG. 3 shows a front view of the support leg in the direction of arrow III of FIG. 2.

The height-adjustable support leg for furniture according to the present invention is primarily characterized by:

An upper leg portion and a lower leg portion;

A pivot for pivotably connecting the upper and the lower leg portions to one another;

The lower leg portion pivotable from a horizontal position in which the lower leg portion rests on a floor surface into a stretched position in which the lower leg portion is aligned with the upper leg portion;

A latching mechanism for securing the lower leg portion in the stretched position against pivoting;

The latching mechanism having at least one latch-shaped release element that is automatically moved into a latching position upon pivoting the lower leg portion from the horizontal position into the substantially vertical position; and The lower leg portion non-slidably connected to the pivot.

According to the present invention, the release element of the latching mechanism, upon pivoting the lower leg portion into the stretched position, is pivoted into a position in which the release element latches or secures the lower leg portion such that it cannot accidentally be pivoted back into the angled position. Since the lower leg portion is pivotable relative to the upper leg portion, but not displaceable or slidable relative to it, the lower leg portion is reliably latched by the release element. The piece of furniture can thus be lifted without the risk that the lower leg portion accidentally can be released from its latched position. Due to the release element the lower leg portion can be secured reliably in its stretched position without any additional securing means so that the inventive support leg can be constructed in a simple manner and is comprised of only a few individual parts.

In a preferred embodiment of the present invention, the release element is connected to the upper leg portion so as to be slidable in a longitudinal direction of the upper leg portion. The release element is preferably biased in a direction toward the latching position. Preferably, the release element has a lower tapered end that is nose-shaped and projects past a lower end of the upper leg portion. The lower tapered end is positioned within a path of movement of the lower leg portion.

Preferably, the release element comprises an upper latch portion and a lower latch portion connected to one another by a step and extending substantially parallel to one another.

Expediently, the upper leg portion has a substantially U-shaped cross-section with two side portions. The upper latch portion rests at a first one of the side portions of the upper leg portion. The upper leg portion has a lower end with a U-shaped cover with lateral legs. The lower latch portion rests preferably at one of the lateral legs of the U-shaped cover.

Advantageously, the lower latch portion has a slotted hole extending in a longitudinal direction of the release element, wherein the pivot has a pivot bearing engaging the slotted hole. Preferably, the upper latch portion has a hook-shaped upper end. The latching mechanism comprises advantageously a grip member with a U-shaped spring. The U-shaped spring is engaged by the hook-shaped upper end of the upper latch portion.

In another preferred embodiment of the present invention, the first side portion of the upper leg portion has an opening through which the U-shaped spring extends. The spring has preferably a spring leg with which the spring is supported at an upper edge of the opening.

Advantageously, the grip member has a triangular shape in a slide view and has a perforation in a side of that triangular shape that extends at an acute angle to the first side portion of the upper leg portion. The spring leg expediently engages with a free end the perforation.

Expediently, the grip member has a support element resting at the first side portion of the upper leg portion. The support element is preferably a stay extending downwardly from the triangular shape of the grip member.

In a preferred embodiment of the present invention, the cover is connected to a lower end of the upper leg portion. The cover engages the lower end of the upper leg portion in a form-fitting (press-fitting) manner and has a bottom for closing off the cover relative to the lower leg portion. Preferably, the lower leg portion is U-shaped and has side portions. The bottom and the lateral legs of the cover have means for receiving free ends of the side portions of the upper and lower leg portions and for receiving the release element.

Advantageously, the lower tapered end of the release element in the latching position projects downwardly past the cover, preferably past the bottom of the cover.

In a preferred embodiment of the present invention, the lower leg portion is U-shaped and has side portions, and the pivot has two pivot bearings connected to the upper leg portion. The grip portion and the side portions of the lower leg portion rest on the pivot bearings of the upper leg portion.

Expediently, the cover has an edge portion connecting the lateral legs. In the latching position the cover is substantially directly adjacent to the upper end of the lower leg portion.

Preferably, the cover, when the lower leg portion is in the horizontal position, extends downwardly past the lower tapered end of the release element.

Advantageously, the cover has an exterior side facing the lower leg portion, the exterior side being curved about a pivot axis of the lower leg portion.

DESCRIPTION OF PREFERRED EMBODIMENTS

The present invention will now be described in detail with the aid of several specific embodiments utilizing FIGS. 1 through 8.

The support leg 1 represented in FIGS. 1 through 8 serves for supporting a table top (not represented) of a folding table for a motor home or a trailer. The table top is screwed onto a fastening plate 4 of the support leg 1 that is connected to the upper leg portion 5 of the two-part support leg 1. Preferably, the fastening plate 4 is welded to the upper leg portion 5. The leg portion 5 is pivotably connected to a second lower leg portion 6. In the lowered position of the table top according to FIG. 1 and FIG. 7, the upper and lower leg portions 5 and 6 are perpendicular to one another while in the lifted upper position of the table top the leg portions are stretched, respectively, aligned with one another (see FIGS. 2–5 and 8). In this position the upper and lower leg portions 5 and 6 are secured against pivoting by a latching mechanism 2.

The leg portions 5 and 6 have a substantially U-shaped cross-section and are comprised of profiled members made of metal; however, they may also be in the form of closed profiled members. The bottoms 7 and 8 of the upper and lower leg portions 5 and 6 are provided with a beaded portion 9, 10 (FIGS. 1, 7, and 8) that extend substantially circumferentially along the entire length and width of the U-shaped profiled member. The beads serve as reinforcements. The side portions 5*a*, 5*b* and 6*a*, 6*b* of the leg portions 5 and 6 are substantially of the same width and are multiple times narrower than the bottom 7 and 8. The ends 11, 12 of the side portions 5*a*, 5*b* of the leg portion 5 facing away from the lower leg portion 6 are preferably welded to the fastening plate 4. They are preferably bent at a right angle (not represented) so that the fastening plate 4 has a real support on the free ends 11, 12. The other free ends 13, 14 of the upper leg portion 5 (FIGS. 5 and 7) are straight. To the free end of the upper leg portion 5 facing the lower leg portion 6 a cover 17 is connected that will be described in detail infra. It projects past the upper end of the lower leg portion 6 such that the intermediate space between the leg portions 5, 6 in the pivoted position is outwardly covered. This prevents that the user upon pivoting of the lower leg portion 6 could be injured by pinching a finger. Simultaneously, the cover 17 serves as a support with which the upper leg portion 5 rests on the floor when the lower leg portion 6 is pivoted into the horizontal position (FIG. 1).

Figure 4:
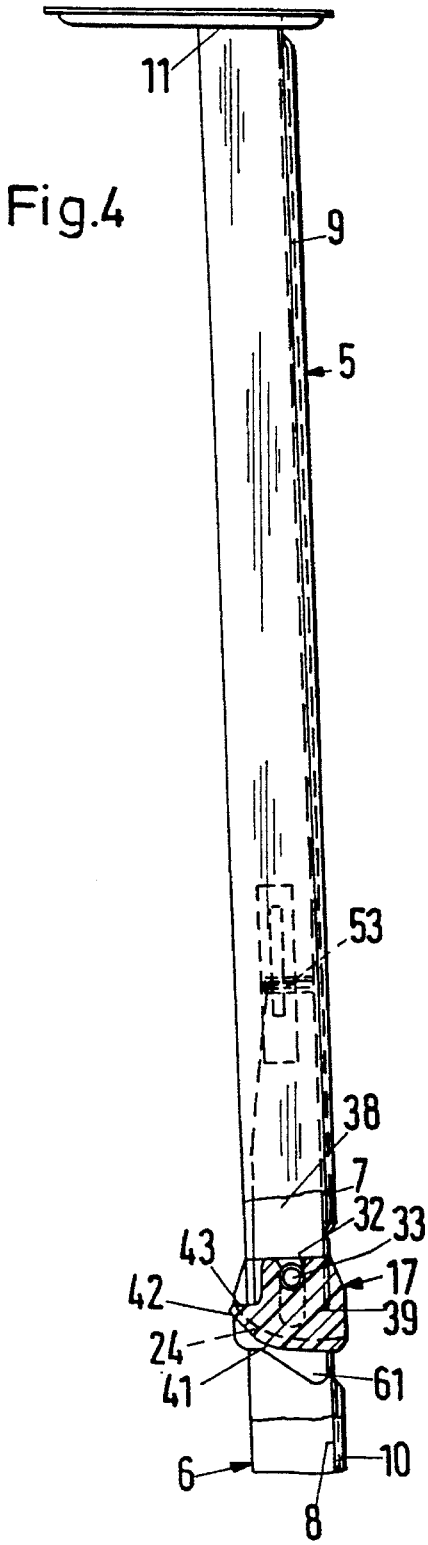
FIG. 4 shows a portion of the support leg of FIG. 1 partially in a side view and partially in section along the line IV—IV of FIG. 6.

The lower free end of the lower leg portion 6 is also provided with a cap-like cover or support 19 that, as the cover 17, is preferably made of plastic material. However, it may also be manufactured of metal. The cover 19 has a U-shaped edge 21 (FIG. 1) into which the lower leg portion 6 is inserted with its lower end. The cover 19 furthermore has a bottom 20 that is connected to the edge 21. With the bottom 20 the lower leg portion 6 is supported on the floor of the trailer or motor home in the stretched or extended position of the support leg. The cover 17 has a shape similar to the cover 19. It also has a U-shaped peripheral edge 22 (FIG. 1 and FIG. 5 to 7) with which it engages the corresponding end of the upper leg portion 5 (FIGS. 4, 8). Furthermore, the cover 17 has a bottom 24 which is perpendicular to the edge 22 and has a width that is approximately the same as the height of the edge 22. When the support leg 1 is in its stretched position, the bottom 24 of the cover 17 is spaced at a minimal distance from the edge 25 of the bottom 8 of the lower leg portion 6 (FIG. 5).

Figure 5:
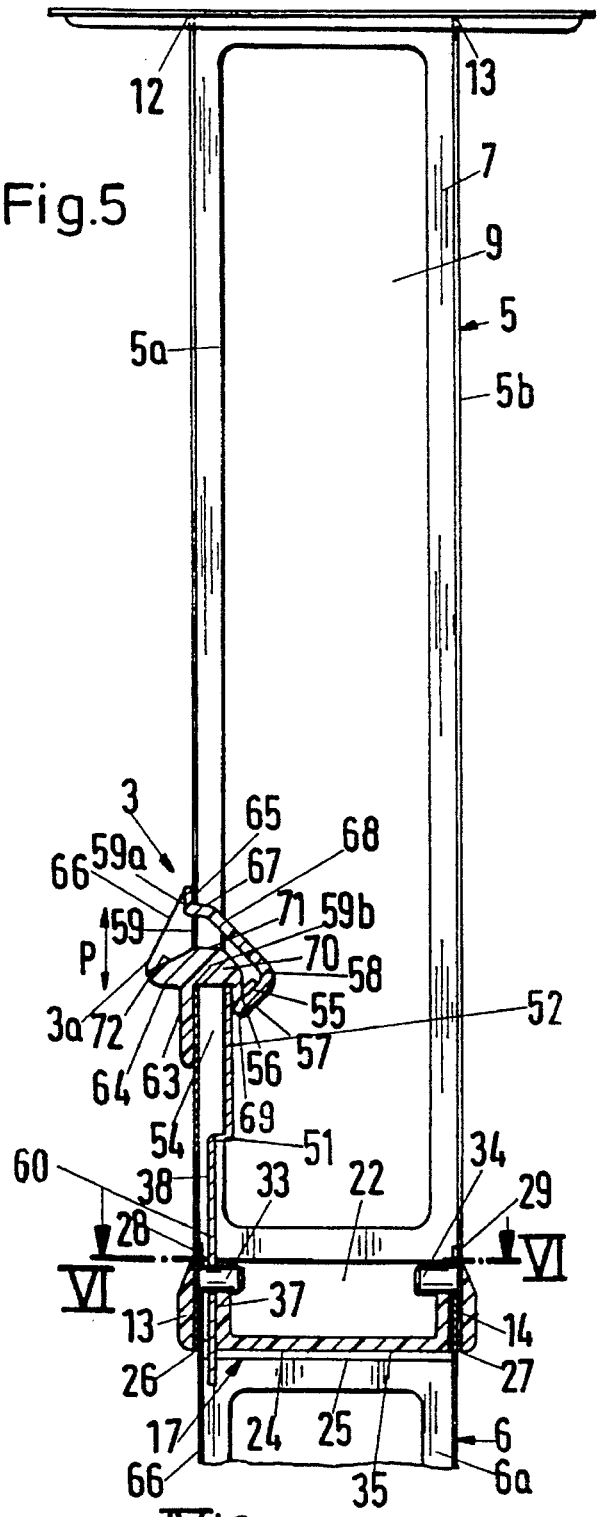
FIG. 5 shows the portion of the support leg represented in FIG. 4 partially in an end view and partially in section.
Figure 6:
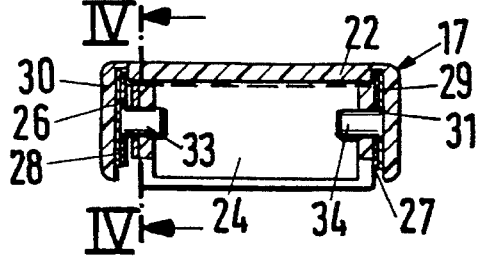
FIG. 6 shows a section along line VI—VI of FIG. 5.

As is especially illustrated in FIGS. 5 and 6, the cover 17 has lateral slots 26, 27 for the free ends 13, 14 of the upper leg portion 5 and the free ends 28, 29 (FIGS. 5 and 6) of the lower leg portion 6. The slots 26, 27 penetrate the bottom 24 of the cover 17 and the lateral legs 30, 31 of the U-shaped edge 22. The lateral legs 30, 31 of the edge 22 of the cover 17 are not embodied in a covered fashion so that they are not unduly weakened by the slots 26, 27. The portions of the lateral legs 30, 31 that are facing each other have a cutout 32 that opens into the upper end of the lateral legs 30, 31 facing away from the bottom 24. Each cutout 37 receives a bearing bolt (pivot bearing) 33, 34 (FIGS. 4 to 8) which are provided at the free ends 13, 14 of the upper leg portion 5. The bolts 33, 34 are aligned relative to one another and extend past the openings, respectively, bores in the free ends 28, 29 of the lower leg portion 6. With the bearing bolts 33, 34 the two leg portions 5, 6 are pivotably connected to one another.

The bearing bolt 33 extends through a slotted hole 37 of a release element 38 of the latching mechanism 2, whereby the slotted hole 37 extends in the longitudinal direction of the upper leg portion 5 (FIGS. 5 through 8). The release element 38 is in the form of a latch and is connected to a grip member 3 of the latching mechanism 2 which will be explained in detail infra.

As is shown in FIGS. 4 and 8, the bottom 7 of the leg portion 5 extends with its end 39 facing the leg portion 6 into a slot 40 of the cover 17. The lower edges 41 (FIG. 4), facing the leg portion 6, of the lateral legs 30, 31 (having the depression 32) of the cover 17 have a portion facing away from the edge 22 that is rounded in a part-circular manner. The bottom 24 of the cover 17 is curved in a similar manner as the edges 41 which are indicated by a dashed line in FIG. 4. The bottom 24 and the edges 41 are curved about the pivoting axis of the bearing bolts 33, 34. This has the advantage that upon pivoting of the leg portions 5, 6 relative to one another the width of the slot 35 between the leg portion 6 and the bottom 24 of the cover 17 remains constant. Since the width of the slot is very small, it is impossible to pinch fingers in the slot 35 during the pivoting of the leg portions 5 and 6. The cover 17 thus serves not only as a support for the leg portion 5, when the support leg 1 is in its angled (pivoted) position, but also as a safeguard against injury.

The bottom 24 of the cover 17 has a transition into the lateral legs 30, 31 in the area of the lateral legs 30, 31 that is in the form of an angled portion 43 (FIG. 4). Accordingly, the portions of the lateral legs 30, 31 having the depression 32 are provided with a nose 42 which projects past the outwardly positioned lateral legs 30, 31 to a limited extent.

Figure 7:
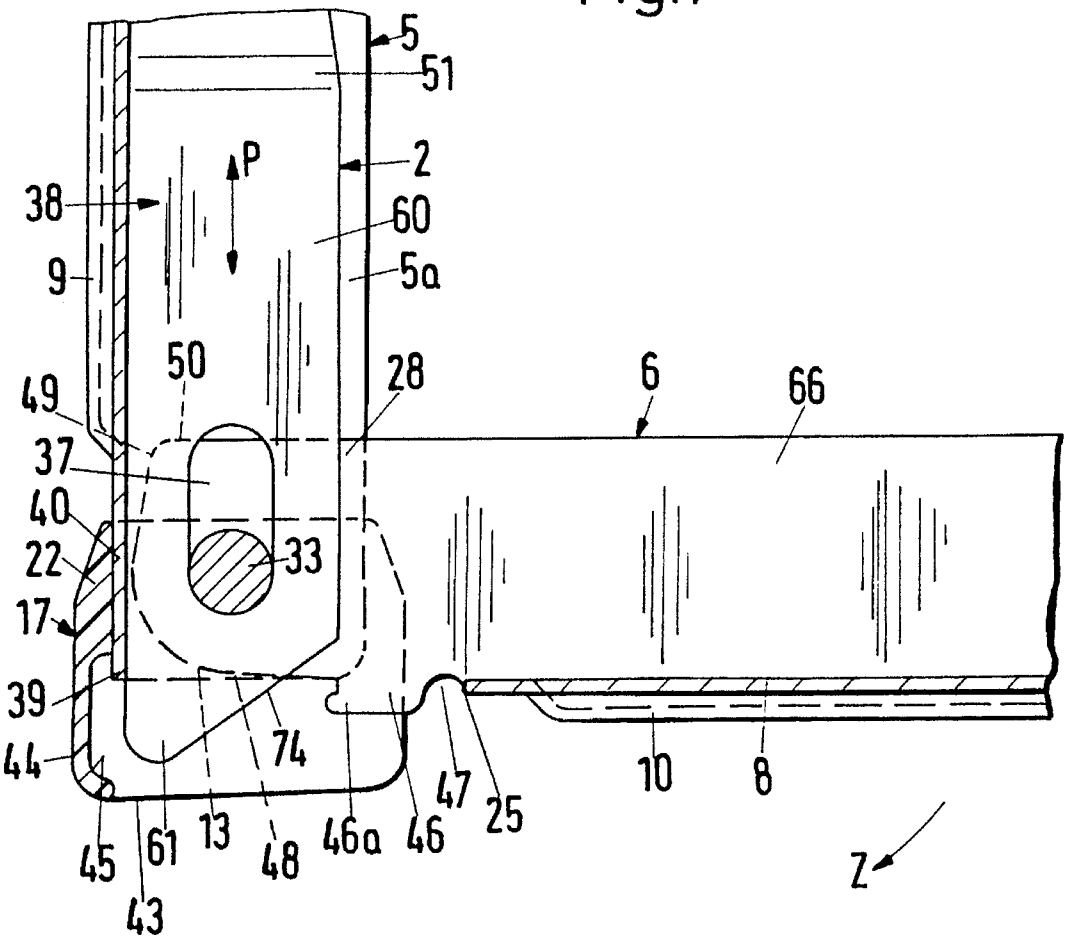
FIG. 7 shows an enlarged detail, partially in section, of a portion of the support leg in its angled (pivoted) position as shown in FIG. 1.
Figure 8:
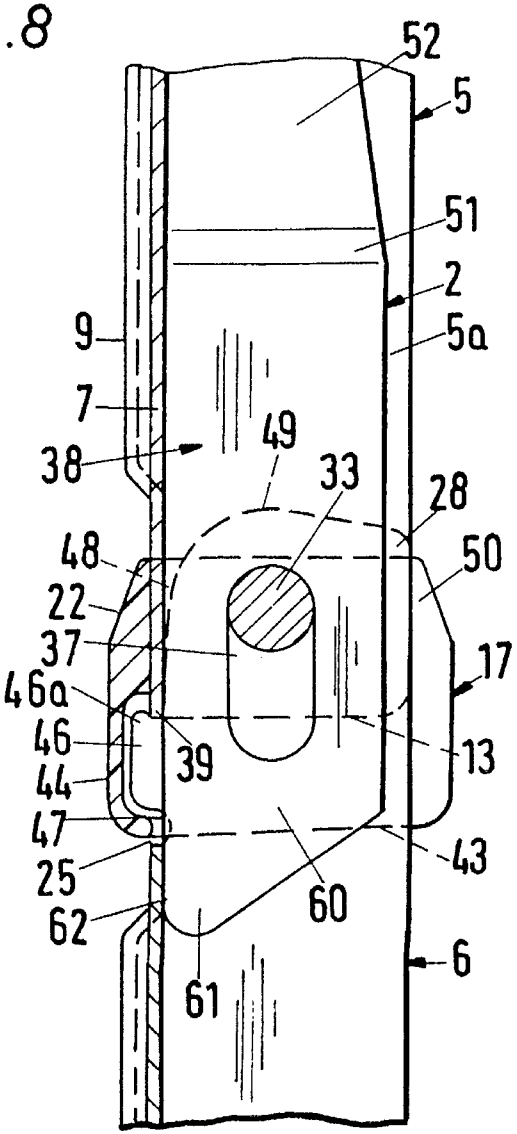
FIG. 8 shows representation corresponding to FIG. 7 whereby the support leg is in the stretched position.

As is shown in FIGS. 7 and 8, the edge 22 of the cover 17 in the area of the lateral slots 26, 27 has a section 44 with a reduced wall thickness as compared to the remaining portions. This section 44 is connected to the end 39 of the leg portion 5. Preferably, the inner side of the edge 22 has a U-shaped recess 45 (FIG. 7) into which the projection 46 of the upper ends 28, 29 of the lower leg portion 6 extend when the support leg 1 is in its stretched position. In the stretched position of the support leg 1 the two projections 46 engage from behind (FIG. 8) the lower end 39 of the leg portion 5 so that an exact positioning of the leg portions 5, 6 relative to one another is ensured.

The projections 46 have a transition in the form of a semi-circular recess 47 into the upper edge 25 of the bottom 8 of the lower leg portion 6. The projections 46 are positioned in the plane of the side portion 6*a*, 6*b* of the leg portion 6 and have substantially a rectangular contour with rounded edges. The projections 46 extend past edges of the side portion 6*a*, 6*b* that are facing the bottom 8. The portions 28, 29 of the side portions 6*a*, 6*b* having the projections 46 project past the bottom 8. The projections 46 have a transition in the form of a semi-circular nose 46 into the rearward edge portion 48 of the corresponding free ends 28, 29 of the leg portion 6 that is substantially aligned with the bottom 8 of the lower leg portion 6. The edge portion 48 has a rounded transition into the edge portion 49 that is positioned at an acute angle relative to the edge portion 48 which, in turn, is connected to a straight edge portion 50. The straight edge portion 50 is the free end of the side portions 6*a*, 6*b* of the lower leg portions 6.

The release element 38 is embodied in the form of a latch and at half its length is provided with a step 51 so that an upper latch portion 52 and a lower latch portion 60 are formed. The upper latch portion 52 rests at the inside of the side portion 5*a* of the upper leg portion 5 in an a real manner. The end 54 of the latch portion 52 facing the grip member 3 is hook-shaped (FIG. 5) and is positioned perpendicular to the latch portion 52. The free end 55 of the hook-shaped end 54 is bent at an obtuse angle and has a hook opening 56 in which a stay 57 of a spring 58 is positioned. The spring 58 extends through an opening 59 in the side portion 5*a* of the upper leg portion 5. The other latch portion 60 rests at the inside of the lateral leg 30 of the cover 17. In the stretched position of the leg portions 5, 6 the bearing bolt 33 (FIG. 8) rests at the upper end of the slotted hole 37 of the release element 38, while in the angular (pivoted) position of the support leg 1 (FIG. 7) it rests at the lower end of the slotted hole 37.

The release element 38 has a lower triangular (tapered) end 61 with which it projects downwardly past the leg portion 5. When the support leg 1 is in its angular (pivoted) position, the lower tapered end 61 is covered by the cover 17. This prevents that the lower tapered end 61, in the position of the support leg 1 according to FIG. 7, could rest on the floor and could be damaged. In the stretched position of the leg portions 5, 6 the release element 38 rests with its lower tapered end 61, respectively, with its rearward edge 62 at the bottom 8 of the leg portion 6. The end 61 thus engages the leg portion 6 that accordingly cannot be pivoted about the bearing bolts 33, 34.

For pivoting the leg portion 6 from the stretched into the angular (pivoted), the release element 38 must be displaced in the upward direction according to arrow P (FIGS. 5 and 7) by activation with the grip member 3. Accordingly, with the hook end 54, 55 the release element 38 is displaced in the same direction into the position represented in FIG. 7. The end 61 of the release element 38 in the upper displaced end position is above the edge 25 of the leg portion 6 so that it can be pivoted into the position represented in FIG. 7.

The grip element 3 has a triangular base body 3*a* as represented in a side view in FIG. 1 and FIG. 5 which in a plan view of the side portion 5*a* of the leg portion 5 has a rectangular contour (FIG. 2) and rests on the outer surface of the side portion 5*a* of the leg portion 5. The base body 3*a* is provided with a downwardly extending stay 63 with which it is guided on the outer surface of the side portion 5*a* of the leg portion 5. The stay 63 extends vertically to the one shorter side of the triangle 64 of the base body 3*a* and forms with its base 65 a common guiding surface. The base body 3*a* is provided with a perforation or slot 66 extending substantially over its entire height in the longitudinal direction into which a free angular end 67 of a longer leg 68 of the spring 58 extends. The angular end 67 is preferably supported under an elastic prestress at the upper end 59*a* of the opening 59 (FIG. 5). The substantially U-shaped spring 58, respectively, its legs have a minimally smaller width than the slots 66. The longer leg 68 of the spring 58 has a substantially rectangular transition into the stay 57 that is connected at an acute angle to a short leg that is parallel to the stay 63. It has a vertical transition into a covered transition section 70 that has a roof-shaped outer surface 71. The outer surface 71 is connected to a bottom surface 72 of the slot 67, which bottom surface 72 is arranged at an obtuse angle to the side portion 5*a*. Preferably, the grip member 3 is comprised of plastic material. The spring 58, respectively, its longer leg 68 are spring-elastic. When the grip member 3 is displaced for pivoting the lower leg portion 6 in an upward direction (direction of arrow P), the base body 3*a* is displaced with the stay 63 and the transition section 70 relative to the leg 68 which is supported with its free end 67 at the edge 59*a* of the opening 59. This results in an elastic bending of the spring leg 68. The base body 3*a* can be displaced maximally to an extent such that the spring leg 68 rests at the bottom surface 71. The transition section 70 provides the grip member 3 with a high stiffness. As soon as the leg portion 6 is pivoted, the grip member 3 can be released. Under the force of the spring leg 68 the base body 3*a* is returned into its initial position according to FIG. 5. The base body 3*a* is then forced by the prestressed spring leg 68 against the lower edge 59*b* of the opening 59.

In a correspondingly simple manner the leg portion 6 can be pivoted back into the stretched position for a lifted table position in the direction of arrow Z in FIG. 7. The lower leg portion 6 with its upper edge 25 comes to rest at the lower tapered end 61 of the release element 38. The tapered end 61 has a guide surface 74 extending at a slant to the pivoting path Z of the edge 25 of the bottom 8 of the leg portion 6. As soon as the edge 25 comes to rest at the guiding edge 74, the release element 38 together with the base body 3*a* is displaced against the force of the spring leg 68 upon pivoting of the leg portion 6. As soon as the edge 25 of the leg portion 6 passes the free end 61, the release element 38 is automatically returned under the force of the spring leg 68 into the latching position according to FIG. 8. Preferably, the free end 61 has a rounded tip so that the edge 25 of the leg portion 6 can be easily pivoted past the release element 38.

The present invention is, of course, in no way restricted to the specific disclosure of the specification and drawings, but also encompasses any modifications within the scope of the appended claims.

What I claim is:

1. A height-adjustable support leg for furniture, said support leg comprising:

an upper leg portion and a lower leg portion;

a pivot for pivotably connecting said upper and said lower leg portions to one another;

said lower leg portion pivotable from a horizontal position in which said lower leg portion rests on a floor surface into a stretched position of said support leg in which said lower leg portion is aligned with said upper leg portion;

a latching mechanism for securing said lower leg portion in said stretched position against pivoting;

said latching mechanism having at least one latch-shaped release element that is automatically moved into a latching position upon pivoting said lower leg portion from said horizontal position into said stretched position;

said lower leg portion non-slidably connected to said pivot; and wherein said release element is biased in a direction toward said latching position and has a lower latch portion with a tapered end that is nose-shaped, wherein, in said latching position, said tapered end projects past a lower end of said upper leg portion and engages said lower leg to prevent pivoting of said lower leg about said pivot.

2. A support leg according to claim 1, wherein said release element is connected to said upper leg portion so as to be slidable in a longitudinal direction of said upper leg portion.

3. A support leg according to claim 1, wherein said release element is biased in a direction toward said latching position.

4. A support leg according to claim 3, wherein said release element has a lower tapered end that is nose-shaped and projects past a lower end of said upper leg portion.

5. A support leg according to claim 4, wherein said lower tapered end is positioned within a path of movement of said lower leg portion.

6. A support leg according to claim 4, wherein said release element comprises an upper latch portion and a lower latch portion connected to one another by a step and extending substantially parallel to one another.

7. A support leg according to claim 6, wherein:

said upper leg portion has a substantially U-shaped cross-section with two side portions;

said upper latch portion rests at a first one of said side portions of said upper leg portion;

said upper leg portion has a lower end with a U-shaped cover with lateral legs; and said lower latch portion rests at one said lateral legs of said U-shaped cover.

8. A support leg according to claim 7, wherein said lower latch portion has a slotted hole extending in a longitudinal direction of said release element, and wherein said pivot has a pivot bearing engaging said slotted hole.

9. A support leg according to claim 7, wherein:

said upper latch portion has a hook-shaped upper end;

said latching mechanism comprises a grip member with a U-shaped spring; and said U-shaped spring is engaged by said hook-shaped upper end of said upper latch portion.

10. A support leg according to claim 9, wherein said first side portion of said upper leg portion has an opening through which said U-shaped spring extends.

11. A support leg according to claim 10, wherein said spring has a spring leg with which said spring is supported at an upper edge of said opening.

12. A support leg according to claim 11, wherein said grip member has a triangular shape in a side view and has a perforation in a side of said triangular shape that extends at an acute angle to said first side portion of said upper leg portion, said spring leg engaging with a free end said perforation.

13. A support leg according to claim 9, wherein said grip member has a support element resting at said first side portion of said upper leg portion.

14. A support leg according to claim 13, wherein said support element is a stay extending downwardly from said triangular shape of said grip member.

15. A support leg according to claim 9, wherein:

said lower leg portion is U-shaped and has side portions;

said pivot has two pivot bearings connected to said upper leg portion; and said grip portion and said side portions of said lower leg portion rest on said pivot bearings of said upper leg portion.

16. A support leg according to claim 7, wherein said cover is connected to said lower end of said upper leg portion.

17. A support leg according to claim 16, wherein said cover engages said lower end of said upper leg portion in a form-fitting manner and has a bottom for closing off said cover relative to said lower leg portion.

18. A support leg according to claim 17, wherein:

said lower leg portion is U-shaped and has side portions; and said bottom and said lateral legs of said cover have means for receiving free ends of said side portions of said upper and lower leg portions and for receiving said release element.

19. A support leg according to claim 17, wherein said lower tapered end of said release element in said latching position projects downwardly past said cover.

20. A support leg according to claim 19, wherein said lower tapered end projects past said bottom of said cover.

21. A support leg according to claim 7, wherein said cover has an edge portion connecting said lateral legs and wherein in said latching position said cover is substantially directly adjacent to an upper end of said lower leg portion.

22. A support leg according to claim 7, wherein said cover, when said lower leg portion is in said horizontal position, extends downwardly past said lower tapered end of said release element.

23. A support leg according to claim 7, wherein said cover has an exterior side facing said lower leg portion, said exterior side being curved about a pivot axis of said lower leg portion.

24. A height-adjustable support leg for furniture, said support leg comprising:

an upper leg portion and a lower leg portion;

a pivot for pivotably connecting said upper and said lower leg portions to one another;

said lower leg portion pivotable from a horizontal position in which said lower leg portion rests on a floor surface into a stretched position of said support leg in which said lower leg portion is aligned with said upper leg portion;

a latching mechanism for securing said lower leg portion in said stretched position against pivoting;

said latching mechanism having at least one latch-shaped release element that is automatically moved into a latching position upon pivoting said lower leg portion from said horizontal position into said stretched position;

said lower leg portion non-slidably connected to said pivot; wherein said release element is biased in a direction toward said latching position and has a lower tapered end that is nose-shaped and, in said latching position, projects past a lower end of said upper leg portion;

wherein said release element comprises an upper latch portion and a lower latch portion connected to one another by a step and extending substantially parallel to one another; and wherein said upper leg portion has a substantially U-shaped cross-section with two side portions, said upper latch portion rests at a first one of said side portions of said upper leg portion, said upper leg portion has a lower end with a U-shaped cover with lateral legs, and said lower latch portion rests at one said lateral legs of said U-shaped cover.

* * * * *